United States Patent [19]

Berroth

[11] Patent Number: 4,921,244

[45] Date of Patent: May 1, 1990

[54] APPARATUS FOR POSITIVE MUSCLE TRAINING

[76] Inventor: Kurt Berroth, 7141 Schwieberdingen, Nippenburg, Fed. Rep. of Germany

[21] Appl. No.: 252,374

[22] Filed: Sep. 30, 1988

[30] Foreign Application Priority Data

Sep. 30, 1987 [DE] Fed. Rep. of Germany ..... 3732883

[51] Int. Cl.[5] ..... A63B 21/06

[52] U.S. Cl. ..... 272/117; 272/118; 272/129; 73/379; 340/665

[58] Field of Search ..... 272/117, 118, 130, 134, 272/129; 73/379; 340/573, 665, 671

[56] References Cited

U.S. PATENT DOCUMENTS

| | | | |
|---|---|---|---|
| 4,650,185 | 3/1987 | Cartwright | 272/117 |
| 4,746,113 | 5/1988 | Kissel | 272/118 |
| 4,750,739 | 6/1988 | Lange | 272/130 |
| 4,765,610 | 8/1988 | Sidwell | 272/117 |

*Primary Examiner*—Richard J. Apley
*Assistant Examiner*—Joe H. Cheng, Jr.

[57] ABSTRACT

An apparatus for positive muscle training has a motor-driven auxiliary force device for applying a force to aid the force applied by the trainee to overcome a weight or other counterforce. A control device senses the speed of movement of a cable caused by the force applied by the trainee and actuates the motor of the auxiliary force device when the speed falls below a predetermined value. The control device causes the auxiliary force to increase gently from zero until the predetermined value is reached once more.

12 Claims, 1 Drawing Sheet

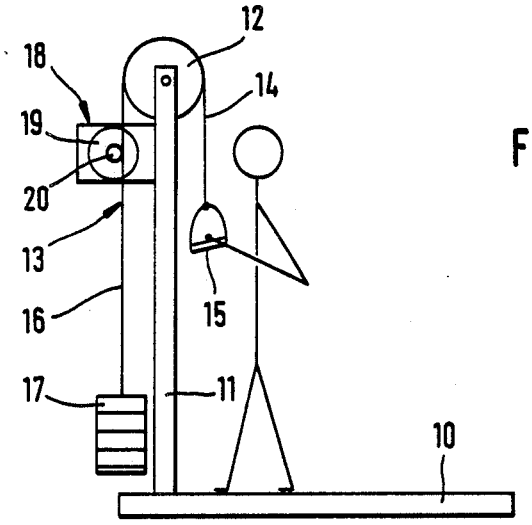
FIG. 1
FIG. 2
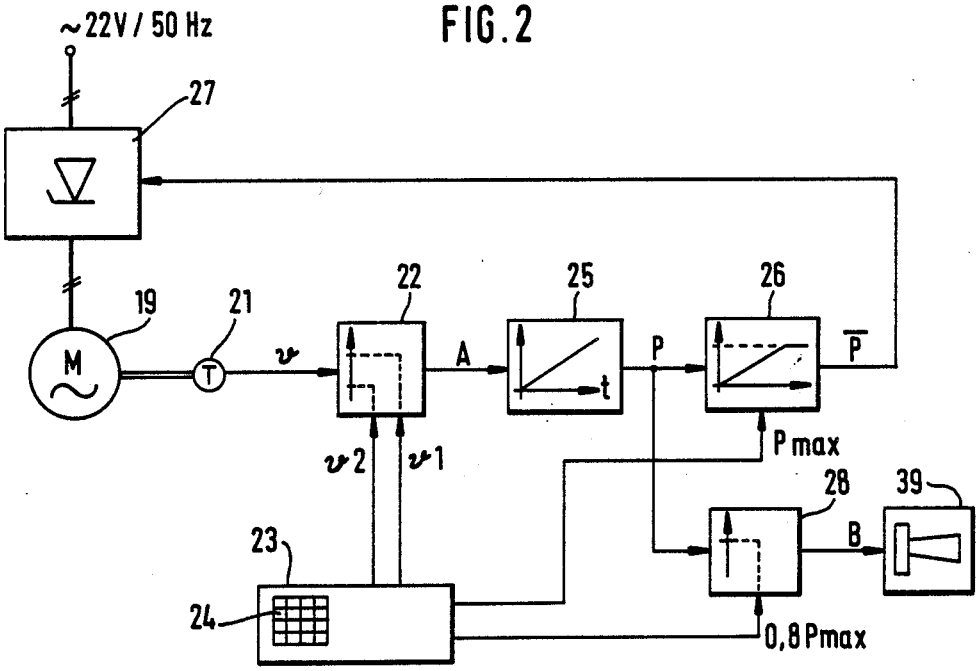

APPARATUS FOR POSITIVE MUSCLE TRAINING

The invention relates to an apparatus for positive muscle training.

BACKGROUND OF THE INVENTION AND RELEVANT PRIOR ART

Gym equipment for muscle development takes various forms depending upon the muscles to be exercised. The trainee applies the force of his or her muscles to the equipment by a handle, a pedal, a lever or other device. Generally, the trainee's muscle force is transmitted through levers, cables and pulleys to weights or springs that provide counterforces to the trainee's muscle force.

In positive muscle training the trainee moves the handle, pedal or the like against a counterforce and repeats this movement many times. For building muscles the last two or three repetitions are executed in what is called the performance range. This is beyond the threshold where the trainee's performance capacity is already overstretched. In this range the exhausted muscle force no longer quite suffices to complete the movement. The trainee then depends upon the assistance of another person who must finely and sensitively give him a little help so that the movement does not stall. If, however, the aid is too great, this is detrimental. However, it is very difficult for a training partner to correctly regulate this assistance because the training partner is experiencing the after effect of his own strenuous exercise. Training on ordinary apparatus therefore frequently is inadequate for training success. The necessity of outside assistance further requires adaptation to the training program helper, and costs the time of both training program helper and trainee.

Training machines with processor-controlled "brake motors" are known, which offer the desired resistance to movement according to a predetermined characteristic curve and under program control. In the performance range beyond the threshold the person under training, by pressing a button, can reduce the the brake resistance by stages when he sees that his movement could be stalled. However, this hurts the trainee's ability to concentrate on executing the exercise. When the "dead point" is overcome, the original loading should become effective again, but since a switch would have to be actuated for that purpose, this resetting is often omitted.

Manually reducing the braking force also may risk reducing the resistance too much whereby the training results are impaired.

If the trainee overestimates his capacity the braking forces may be reduced too little, in which case the movement cannot be completed and again the training suffers.

OBJECT AND STATEMENT OF THE INVENTION

The object of the invention is to provide an apparatus of the stated type such that an optimum training function is possible without the aid of a second person and without detracting from the trainee's ability to concentrate. It is also an object to be able to practice the invention by modifying conventional training equipment.

These objects are achieved by the following invention.

The invention has means for applying muscle force, means connected to the muscle force applying means for applying a force that counteracts the muscle force, a motor driven auxiliary force device connected to the muscle force applying means for applying an auxiliary force in aid of the muscle force, and a control device comprising sensor means, means connected to the sensor means and the auxiliary force device for actuating the auxiliary force device when the speed of movement of the muscle force applying means falls below a predetermined upper speed, and means for increasing the auxiliary force gently from zero to a predetermined maximum value as long as the predetermined upper speed is not reached.

The motorized auxiliary force equipment is a training partner who is always available and is active when needed. This auxiliary force equipment can in principle be attached to every conventional training appliance, the nature of the the mechanical coupling having of course to be adapted individually.

Also, because the control device comprises sensors for the detection of the speed of the movement of the muscle force applying means and is so formed that on falling below the upper predeterminable speed the auxiliary force is added, assistance is derived in a simple manner. Also, because the auxiliary force comes into action in a gently rising manner, it is optimally regulated in an elegantly simple manner for it only becomes as great as necessary to maintain the predetermined speed of the movement.

In addition, the embodiment described includes the following additional advantageous features:

The upper speed limit and the maximum value of the auxiliary force are predeterminable in accordance with a training program.

The maximum value of the auxiliary force amounts to 25% of the maximum applicable muscular force according to the training program. A maximum value in accordance with this range has proved expedient. If a greater auxiliary force had to be applied to maintain the movement, this would mean merely that the training program is wrong. The control device is formed so as to give a warning signal as soon as the auxiliary force is greater than 80% of its predetermined maximum value. The warning signal, if it occurs too often, can serve to indicate the need to chance the training program.

The control device is contructed so as to add no auxiliary force when the speed of movement falls below a lower predeterminable speed limit. The warning also prevents a surprise because if the trainee becomes exhausted the auxiliary force will switch off.

The auxiliary force device and the control device are formed as an accessory unit which is couplable to the muscle force applying means. The auxiliary device comprises an electric motor with torque control. The electric motor comprises a single-phase asynchronous squirrel-cage motor. The torque control is provided as a phase control system. A tachometer generator coupled with the motor shaft is provided as a sensor for the speed of the movement.

DESCRIPTION OF THE DRAWINGS

FIG. 1 shows an apparatus according to the invention in highly diagrammatic simplification, FIG. 2 shows a simplified circuit diagram of a control device with electric motor.

For the purpose of illustration of the principle a quite simple weight-lifting apparatus is indicated diagrammatically in FIG. 1. On a base 10 there stands a column 11 at the top of which a reversing pully 12 is mounted.

A cable 13, the forward run 14 of which is connected with a handle 15 and the rear run 16 of which is connected with a weight 17, is guided in a circumferential groove of the reversing pulley 12. The indicated person can introduce muscular force by the handle 15, drawing the latter towards the base 10. In doing so the counterforce of the weight 17 must be overcome.

On the column 11, close to the reversing pulley 12, there is secured an accessory unit 18 comprising an electric motor 19, the drive-output shaft 20 of which is indicated, and a control apparatus which is not separately illustrated. The cable 13 is for example wound once around the drive output shaft, whereby a simple coupling to the force path of the training apparatus is realized. It is understood that this serves only as a diagrammatic example.

The circuit diagram of the control apparatus according to FIG. 2 is likewise simplified for the purpose of illustration. According to this, the electric motor 19 is connected to a tachometer generator 21 from which a voltage v proportional to the rotation rate and thus to the speed of movement of the cable 13 is tapped and applied, possibly through an amplifying means, to a comparator 22. This generates a switch signal A of for example 1 volt at its output only if the voltage lies between an upper limit value v1 and a lower limit value v2. These limit values are determined by a control circuit 23 on the basis of a presetting through the keyboard 24 thereof. If the voltage v is greater than the upper limit value v1, this indicates that the muscular power of the training person suffices to execute the movement with a minimum speed conforming to the training program. If, the muscular power is reduced to a range below the threshold, the speed drops below this limit value, which means that assistance is necessary. If, however, despite assistance, the speed of movement fails off still further and finally drops below the lower limit value v2, this indicates that the exercise cannot be completed and consequently no further auxiliary force is necessary.

The switch signal A, which indicates the necessity of assistance, activates a function generator 25. The function generator 25 delivers at its output a signal P as a function of time, with a voltage rising gradually from zero. This signal P is conducted by way of a limiter 26 as signal $\overline{P}$ to a torque control system 27. This torque control system 27 is a phase control system with thyristors. The magnitude of the signal P or $\overline{P}$ according to the characteristics of the phase control system and of the electric motor represents the magnitude of the torque. Consequently the motor torque starts to act gently and increases equally gently. The torque rises only up to a maximum value of 25% of the maximum muscular force to be applied in the training program. A rise of the signal $\overline{P}$ above the limit value Pmax is suppressed. Pmax is predetermined by the control circuit 23. For this purpose, by way of example, the value G of the weight 17 is keyed into the control circuit and Pmax is calculated internally (Pmax=0.25 G).

The signal P is also applied to a comparator 28, which receives a reference voltage of 0.8 Pmax from the control circuit. The comparator 28 delivers a signal B to a signal device 39 as soon as the auxiliary force is greater than 80% of its predetermined maximum value (Pmax). This signal device 39 then gives off an optical and/or acoustic warning signal.

According to the above example the auxiliary force is switched off immediately as soon as the voltage falls below the lower limit value v2. It is possible to provide a time-delayed holding member which then maintains the switch signal A for example for one second. Thus a brief slump in performance of the training person does not lead immediately to breaking off the exercise, but rather the auxiliary force remains available. The lower limit value v2 can represent a slow speed variable with the training program or can be an invariable limit, in particular one that is stationary. The upper limit value v1 depends upon the training program and is variable and predetermined accordingly. It can for example be correlated with the weight G, so that v1 is calculated in the control circuit itself.

When weights of 10 to 150 kg. are to be lifted the electric motor 19 must supply an auxiliary force of 37.5 kg. at maximum. This can be readily achieved with an asynchronous squirrel-cage motor in a single phase Steinmetz circuit arrangement, working with an operating capacity of an engine size 80.

The circuit diagram according to FIG. 2 is based upon analog signals, but digital signal processing is also possible. As additional equipment (not shown separately) it is also possible to provide various analysis of the training program, such as an indication of repetitions of movement as a whole and for how many repetitions an auxiliary force was added. The latter is expedient because the person undergoing training often does not notice that assistance is being provided because the auxiliary force comes into action gently.

What is claimed is:

1. Apparatus for muscle training comprising means for applying muscle force, means connected to the muscle force applying means for applying a force that counteracts the muscle force, a motor driven auxiliary force device connected to the muscle force applying means for applying an auxiliary force in aid of the muscle force, and a control device to actuate the auxiliary force device, the control device comprising sensor means for detecting speed of movement of the muscle force applying means, means connected to the sensor means and the auxiliary force device for actuating the auxiliary force device when the speed of movement of the muscle force applying means falls below a predetermined upper speed, and means for gently increasing the auxiliary force from zero value to a predetermined maximum value as long as the predetermined upper speed is not reached.

2. Apparatus according to claim, 27 wherein the predetermined upper speed and the predetermined maximum value of the auxiliary force are predetermined in accordance with a training program.

3. Apparatus according to claim 2, wherein the predetermined maximum value of the auxiliary force is 25% of the maximum appliable. muscular force according to the training program.

4. Apparatus according to claim 3, wherein the control device is arranged to actuate a warning signal means as soon as the auxiliary force is greater than 80% of its predetermined maximum value.

5. Apparatus according to claim 16, wherein the control device is arranged to actuate a warning signal means as soon as the auxiliary force is greater than 80% of the predetermined maximum value of the auxiliary force.

6. Apparatus according to claim, 1 wherein the actuating means of the control device is arranged discontinue actuating to the auxiliary force device when the speed of movement of the muscle force applying means falls, below a lower predeterminable speed.

7. Apparatus according to claim, 1 wherein the auxiliary force device and the control device are formed as an accessory unit which is couplable to the muscle force applying means.

8. Apparatus according to claim, 1 wherein the auxiliary force device comprises an electric motor with torque control.

9. Apparatus according to claim 8, wherein the electric motor comprises a single-phase asynchronous squirrel-cage motor.

10. Apparatus according to claim 9, wherein the torque control is provided as a phase control system.

11. Apparatus according to claim 8, wherein the sensor means comprises a tachometer generator coupled with a motor shaft of the electric motor.

12. Apparatus according to claim, 1 wherein the sensor means comprises a tachometer generator coupled with a motor shaft of the auxiliary force device.

* * * * *

UNITED STATES PATENT AND TRADEMARK OFFICE

CERTIFICATE OF CORRECTION

PATENT NO. : 4,921,244

DATED : May 1, 1990

INVENTOR(S) : Kurt Berroth

It is certified that error appears in the above-identified patent and that said Letters Patent is hereby corrected as shown below:

Column 4, Claim 2, line 1, after "claim" correct "27" to read -- 1 --

Column 4, Claim 4, line 4, correct the line to read -- of the predetermined maximum value of the auxiliary force. --

Column 4, Claim 5, line 1, after "claim" correct "16" to read -- 2 --

Column 4, Claim 6, lines 2 and 3, after "arranged" correct these lines to read -- to discontinue actuating the auxiliary force device when the --

Signed and Sealed this

Ninth Day of July, 1991

*Attest:*

*Attesting Officer*

HARRY F. MANBECK, JR.

*Commissioner of Patents and Trademarks*